United States Patent [19]

Dickson

[11] Patent Number: 5,046,890

[45] Date of Patent: Sep. 10, 1991

[54] ROAD SURFACE TREATING APPARATUS

[75] Inventor: Wayne E. Dickson, Tecumseh, Okla.

[73] Assignee: Dickson Industries, Inc., Tecumseh, Okla.

[21] Appl. No.: 548,284

[22] Filed: Jul. 2, 1990

[51] Int. Cl.[5] ..... E02B 07/20; E21C 47/00

[52] U.S. Cl. ..... 404/90; 299/39

[58] Field of Search ..... 404/90; 299/39

[56] References Cited

U.S. PATENT DOCUMENTS

| | | | |
|---|---|---|---|
| 4,778,304 | 10/1988 | Baldi et al. | 299/39 X |
| 4,854,770 | 8/1989 | Puchala et al. | 404/90 |
| 4,878,713 | 11/1989 | Zanetis | 404/90 |
| 4,896,995 | 1/1990 | Simmons | 299/39 |

*Primary Examiner*—Ramon S. Britts
*Assistant Examiner*—Nancy P. Connally
*Attorney, Agent, or Firm*—Laney, Dougherty, Hessin & Beavers

[57] ABSTRACT

A road surface treating apparatus including a wheel-supported framework having forwardly extending arms pivotally carried thereon. The arms have a transversely extending tool bar mounted to their forward ends. A tool-supporting frame is detachably and adjustably mounted on the tool bar. A cutter drum housing is pivotally mounted on the tool-supporting frame for floating pivotation about a horizontally extending, fore-and-aft axis to facilitate side-to-side rocking movement of the drum housing. A cutter drum is rotatably mounted in the housing and carries circumferentially spaced rows of cutter blades each mounted for rotation about a horizontal axis. A pair of horizontally spaced, shock absorber units is connected between the housing and tool-supporting frame to damp and smooth the side-to-side rocking movement of the housing and the cutter drum mounted therein.

5 Claims, 4 Drawing Sheets

ROAD SURFACE TREATING APPARATUS

FIELD OF THE INVENTION

This invention relates to machines used for scarifying, abrading and generally treating the surface of roadways, and more particularly, to apparatus which can be mounted on a tool bar carried at the forward end of an automotive vehicle, and operated from that vehicle to treat the surface of a roadway.

BRIEF DESCRIPTION OF THE PRESENT INVENTION

The present invention is a road surface treating apparatus which can be employed for abrading, scarifying or sawing the surface of road preparatory to refinishing the road. A cylindrical cutter drum assembly pivotally mounted within a floating drum housing carries a plurality of circular cutting plates. Each of these plates has a plurality of circumferentially spaced cutter disks carried thereon. The cutting plates are mounted upon a central shaft of the cutter drum assembly and are driven in rotation by a power train which extends from, and is drivingly connected to, a prime mover carried on a wheeled vehicle upon which the road surface treating apparatus of the invention is detachably mounted. The cutter drum housing is mounted on a tool-supporting frame subassembly by means of a pivot post. The pivot post pivotally supports the cutter drum housing and enables it to pivot about a rearwardly extending horizontal axis so that either end of the cutter drum housing can float up or down as may be necessary to accommodate the housing and the cutter drum which it carries to uneven places in a roadway, or surface anomalies or aberrations which would otherwise damage the machine, or tend to dull the cutting disks carried thereon. Pivoting or swinging movements of the cutter drum housing are damped by means of a pair of stabilizer damping units which resiliently retard and soften the extremes of movement of the cutter drum housing as anomalies in the roadway cause displacements of the housing from a transversely extending, substantially level attitude.

An important object of the invention is to provide a road surface treating apparatus which permits a wide range of interchangeability of specialty tooling operatively mounted on an automotive vehicle. Thus, the scarifying and cutting knives employed in one widely used embodiment of the invention can be replaced by rotary brooms, devices for concrete and asphalt milling, concrete sawing heads and other types of replacements for the rotary cutter housing and the rotary cutter drum rotatably carried therein as described herein as typifying one embodiment of the invention.

A further object of the invention is to provide a grinder tool for scarifying or cutting the surface of a roadway, which too includes a rotary drum housing having a rotary cutting drum mounted therein, with the housing supported on a carrying vehicle so that the tool can float both longitudinally and laterally, thereby allowing for irregular work surfaces.

Another object of the invention is to provide a road surface treating apparatus which carries a housing for a rotary grinder, and in which the grinder head can be selectively mounted on the left side or the right side or in the center of the machine, if such should be desired.

A further object of the invention is to provide a rotary grinder for treating the surface of a roadway with the grinder elements mounted for rotation within a housing which is mounted for a full floating support so as to be able to float freely both longitudinally and laterally, thereby providing for a longer cutting life characterizing the machine, with minimal road surface damage resulting.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

The road surface treating apparatus of the invention may be considered as an adjunct to, or system which is mountable on, a wheeled, powered vehicle for movement along a roadway, with control being effected from the wheeled vehicle. The wheeled vehicle carries a prime mover which drives that vehicle, and also drives certain moving parts of the road surface treating apparatus of the invention. Generally, the vehicle which has the apparatus of the invention mounted thereon will include a chassis or framework, and will carry a prime mover mounted on the chassis and from which the power used to drive the apparatus of the invention is derived.

Figure 1:
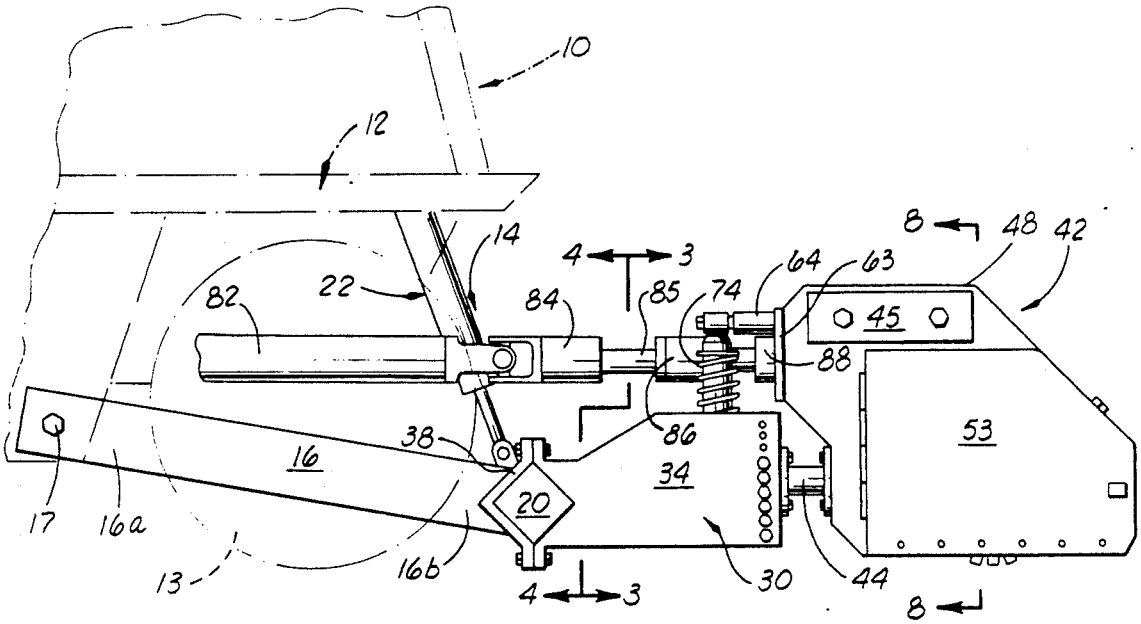
FIG. 1 is a side elevation view of the road surface treating apparatus of the present invention. A vehicle to which the apparatus is mounted is shown in dashed lines.

In FIG. 1 of the drawings, the prime mover-carrying, powered vehicle is designated generally by reference numeral 10 and includes a chassis or framework 12 which is movably supported upon a pair of ground-engaging wheels 13 and 15. The vehicle 10, framework 12 and ground-engaging wheels 13 and 15 are portrayed in dashed lines in FIGS. 1 and 2 of the drawings.

A power train subassembly, designated generally by reference numeral 14, and hereinafter described in greater detail, is connected at one end to the prime mover (not shown) carried on the chassis or framework 12, and is drivingly connected at its other end to a rotatably supported cutter drum assembly forming a part of the apparatus of the present invention and hereinafter described.

A pair of substantially parallel, elongated forwardly projecting arms 16 and 18 are connected to the chassis for upward and downward pivotation about a horizontal axis. Thus, the elongated arm 16 has a rear end 16*a* (see FIG. 1) which is connected to the chassis 12 by a suitable pivot pin 17 which permits this arm to pivot up and down. In the same fashion, the arm 18 has a rear end 18*a* which is pivotally connected by a pin 19 to the chassis 12 of the vehicle 10. The arms 16 and 18 are relatively long and are connected to the chassis 12 at a place relatively far back toward the rear of the chassis. This permits the lever arm length between the points of pivotal connections of the arms 16 and 18 to the chassis, and the place where the working tool (later described) is mounted at the forward end of the machine, to be relatively large, so that slight up-and-down movements of the cutting tool operating on the surface of the roadway can be better accommodated due to the length of the lever arms which are provided.

Figure 11:
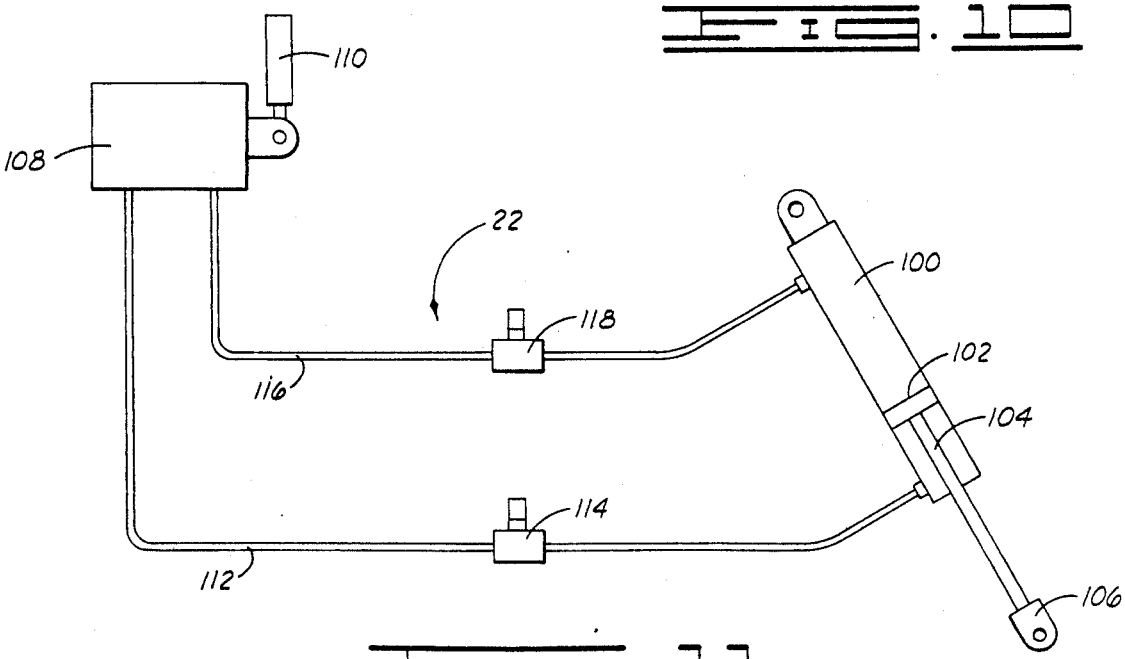
FIG. 11 is a schematic hydraulic fluid flow diagram.

Each of the forwardly projecting arms 16 and 18 also has a forward end, these being denominated generally by reference numerals 16*b* and 18*b*, respectively. Supported at the forward end of each of the forwardly projecting arms 16 and 18 is an elongated, substantially horizontally extending transverse tool bar 20. The tool bar 20 can be secured to the forward ends of the arms 16 and 18 in any suitable way, and generally extends horizontally and transversely with respect to the direction of movement of the prime mover vehicle 10. The transverse tool bar 20 illustrated in the drawings, and used in a preferred embodiment of the invention, is a large square cross-sectioned tubing element which is supported in the position illustrated in FIGS. 1, 2, 4 and 5 of the drawings. A hydraulic tool bar control subassembly 22 is provided and extends between the vehicle 10 and the tool bar 20, so as to permit the tool bar to be elevated and lowered hydraulically as the arms 16 and 18 pivot about the rear end portions of each arm. The control subassembly 22 also facilitates applying a downward force to knives or cutters carried on the tool bar 20 and used to work or treat the roadway surface, if this should be desirable. The control subassembly 22 is shown in FIG. 11 of the drawings and is hereinafter described in detail.

A tool-supporting frame subassembly 30 is detachably connected to the transverse tool bar 20, and projects on the opposite side of this tool bar from the side thereof to which the forward ends of each of the forwardly projecting arms 16 and 18 are connected. The tool-supporting frame subassembly 30, which is clearly illustrated in FIGS. 1, 3, 5 and 6, includes a pair of parallel, forwardly extending side frame plates 32 and 34 which extend from the transverse tool bar 20 as shown in FIGS. 1, 5, 6 and 7.

Each of the forwardly extending frame plates 32 and 34 carries a V-notch at the rear end thereof which permits these frame plates to be detachably secured to the tool bar 20. This is accomplished by the use of a first tool bar clamping bracket 36, which is bolted or otherwise secured to the forwardly extending frame plate 32, and a second tool bar clamping bracket 38 which functions to engage the second of the two forwardly projecting frame plates 34 with the tool bar. Extending between, and secured to, the forward ends of the two forwardly extending frame plates 32 and 34 is a transversely extending frame plate 40. The frame plate 40 extends generally normal to the direction of travel of the vehicle 10, and is welded or otherwise suitably secured at its opposite ends to the forward ends of the frame plates 32 and 34 (see FIG. 5).

A cutter drum housing 42 is pivotally mounted on the forward side of the transversely extending frame plate 40 by a suitable rocker shaft or pivot post 44 so that the cutter drum housing can pivot about a horizontally extending pivotal axis which extends fore-and-aft, or longitudinally with respect to the direction of travel of the prime mover vehicle 10 at a time when the road surface treating apparatus is in use.

Figure 7:
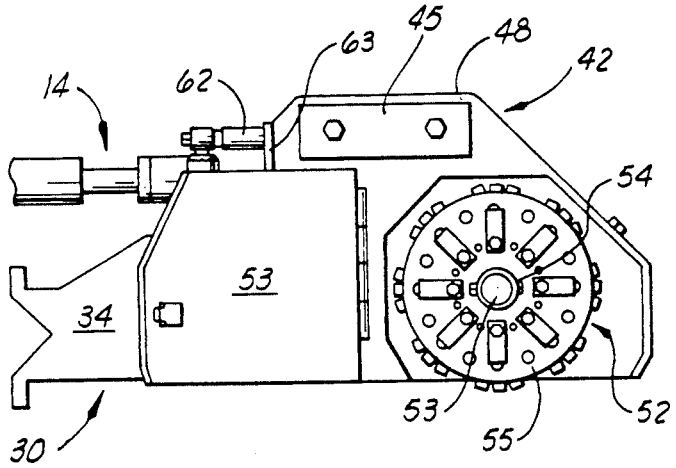
FIG. 7 is a side elevation view of the opposite side of the apparatus from that which is shown in FIG. 6, and showing an access door opened to facilitate access to a rotary cutter drum subassembly rotatably mounted on the inside of a housing in a preferred embodiment of the road surface treating apparatus of the invention.
Figure 8:
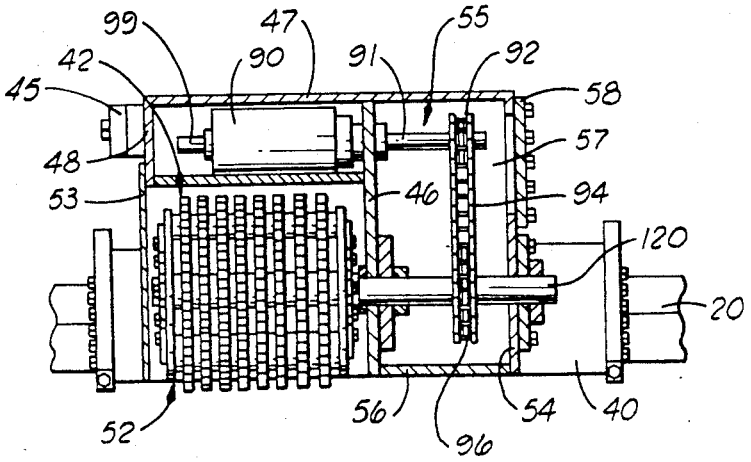
FIG. 8 is a sectional view of the rotary cutter drum subassembly and cutter drum housing forming a part of the present invention.

The rocker shaft 44 is journaled in a suitable bearing which is located slightly below the center (in a vertical sense) of the cutter drum housing so that the drum, which can float about the pivotal axis of the rocker shaft or pivot post 44 as hereinafter described, will tend to self-level itself in following a surface of the road, rather than tending to stay in an elevated position on one end. As will also be apparent from the drawings and the ensuing description, the rocker shaft or pivot post 44 is also connected to the cutter drum housing 42 in the horizontal center of this housing, so that the housing itself is symmetrically located with respect to the axis of the rocker shaft. Since the cutter drum housing 42, as shown in FIG. 8, however, is adjacent, and formed integrally with, a drive chain and sprocket housing 55 which is mounted on the cutter drum housing 42, it is necessary, in order to achieve a balance in the weight acting about the axis of the rocker shaft 44, to mount weights 45 on one end of the cutter drum housing 42 as shown in FIGS. 1, 2, 7 and 8. These weights 45, which can be varied in number and thus in total weight, function to evenly distribute the total weight of the entire floating structure which is permitted to freely pivot about the axis of the rocker shaft 44 which enters the drum housing 42 at precisely the horizontal center thereof as hereinbefore explained.

The rocker shaft 44 permits the cutter drum housing 42 to rock about the horizontally extending axis, so that in its overall position, or attitude, during the operation of the apparatus, the cutter drum housing 42 can follow the surface of the roadway, and yield upwardly or downwardly at either opposed end thereof as may be required to follow closely and treat the roadway surface in question. Such pivotal, free floating mounting of the drum housing 42 is achieved through the use of the forwardly and horizontally extending pivot or rocker shaft 44. This transverse floating capability is coupled with a longitudinal up-and-down movement capability resulting from the pivotal mounting of the arms 16 and 18. The control of this longitudinal up-and-down movement is discussed in detail when the tool bar control subassembly 22, best shown in FIG. 11, is discussed.

Figure 2:
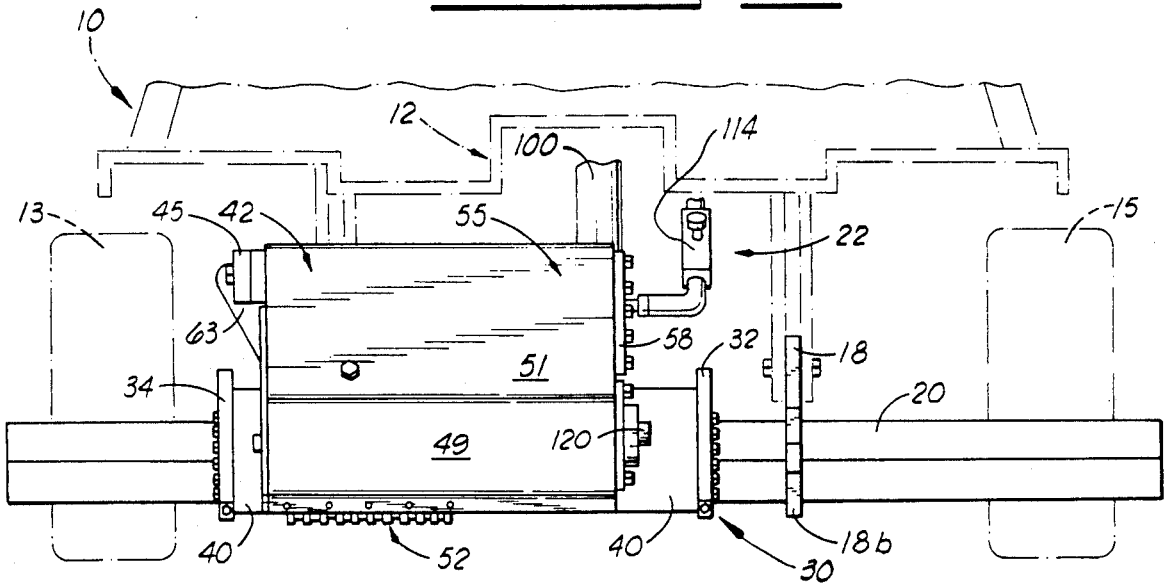
FIG. 2 is a front elevation view of the road surface treating apparatus of the invention, and showing, as background with respect thereto and in dashed lines, a vehicle upon which the apparatus of the invention is mounted.
Figure 3:
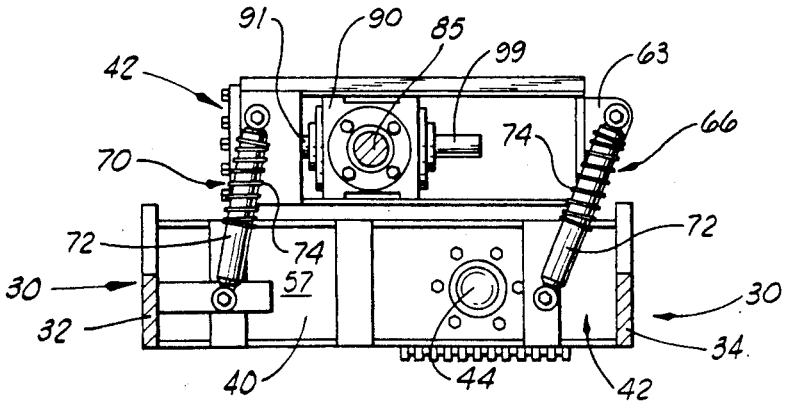
FIG. 3 is a sectional view taken along line 3—3 of FIG. 1, and showing the rear side of the cylindrical cutter drum housing and a part of the drive system therefor, and the shock absorbing units, all forming parts of the present invention.
Figure 4:
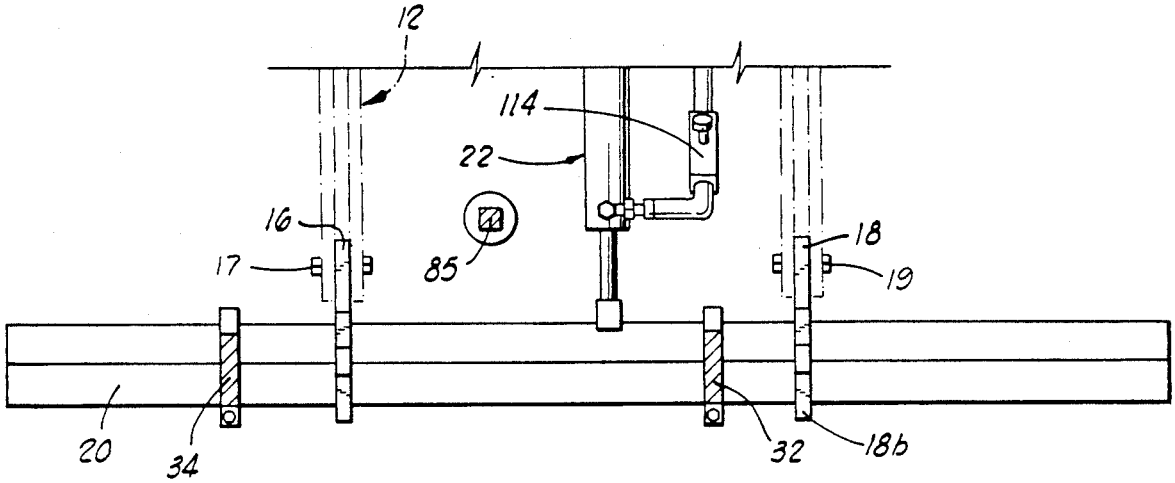
FIG. 4 is a sectional view taken along line 4—4 of FIG. 1.
Figure 5:
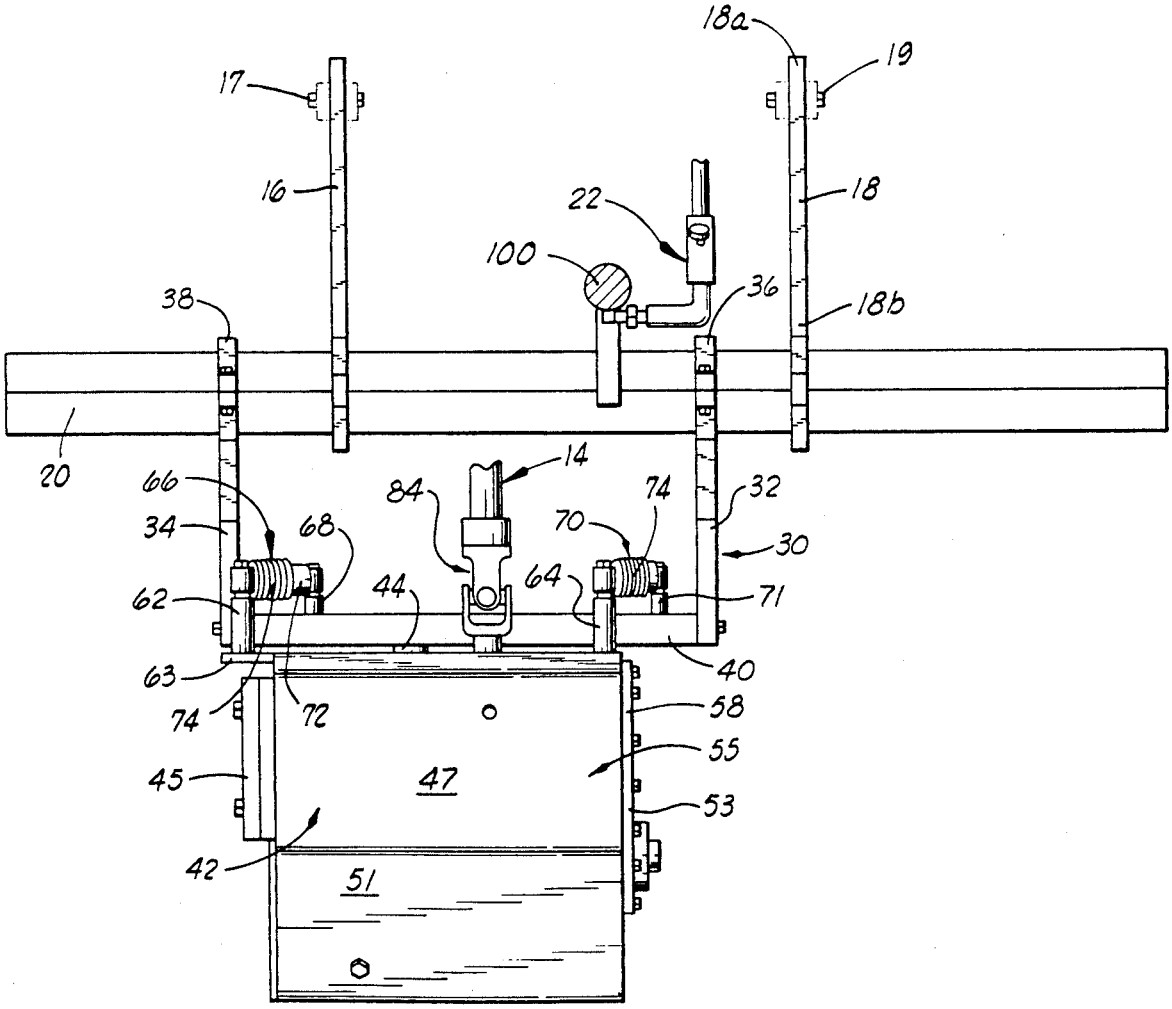
FIG. 5 is a top plan view of the surface treating apparatus of the invention.
Figure 6:
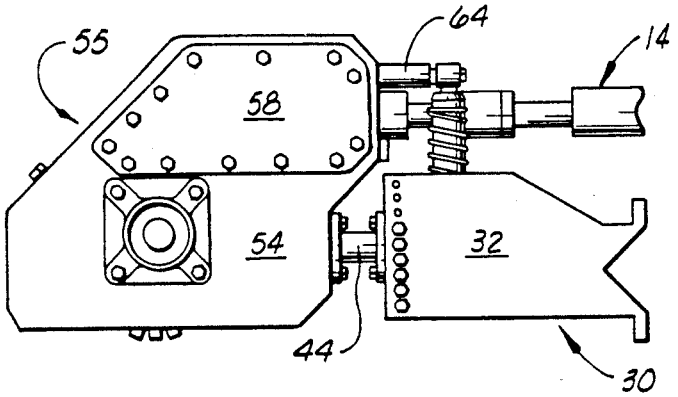
FIG. 6 is a side elevation view of a principle part of the road surface treating apparatus of the invention as that portion of the apparatus which is mounted upon a transversely extending tool bar appears when viewed in side elevation.

The cutter drum housing 42 includes a partition plate 46, an outer end plate 48, a transversely extending common top wall 47, a transversely extending common vertical forward wall 49, and an inclined common forward wall 51 which extends between the top wall and the vertically extending forward wall 49 (see FIG. 2). The outer end plate 48 is provided with a large opening (see FIG. 7) which provides access to the rotary cylindrical cutter drum subassembly 52 mounted within the drum housing 42 in a position, and for a purpose, hereinafter described. This opening in the second end plate 48 is normally closed by a cutter drum access door 53 as best shown in FIGS. 1 and 7.

On the opposite sides of the partition plate 46 from the cutter drum housing 42, a drive chain housing 55 is located (see FIG. 8). The drive chain housing 55 includes an end wall 54, an end portion of the transversely extending common top wall 47, an end portion of the transversely extending common vertical forward wall 49, and an end portion of the inclined common forward wall 51. The drive chain housing 55 also includes a bottom plate 56 which, with a back wall 57, completely closes the space within which a drive chain and other parts of the power train subassembly 14 are located. A transmission access plate 58 is removably mounted on the end wall 54 and closes the access opening formed through the chain housing end wall (see FIG. 6). When the transmission access plate 58 is removed, this opening facilitates access to a drive sprocket 92 and drive chain 94 forming a part of the power train assembly 14 (hereinafter described in detail) which extends from a prime mover on the vehicle 10 to the primary central shaft of the cutter drum subassembly 52, as hereinafter described.

For the purpose of imparting desirable damping or stabilization to the transverse rocking movements of the cutter drum housing 42 and the cylindrical cutter drum subassembly 52 which is rotatably mounted therein, as hereinafter described, a stabilization system is provided. The stabilization system includes a first rearwardly projecting upper stabilizer post 62 which projects rearwardly from an ear plate 63 on the drum housing 42 near one end of the housing. A second rearwardly projecting upper stabilizer post 64 is located at the end of the drive chain housing 55 and projects rearwardly substantially parallel to the first rearwardly projecting upper stabilizer post 62.

Secured to the first rearwardly projecting upper stabilizer post 62 is the upper end of a first stabilizer damping unit or booster shock 66. At its lower end, this first stabilizer damping unit 66 is connected to a first rearwardly projecting lower stabilizer post 68 (see FIG. 5).

A second stabilizer damping unit or booster shock 70 has its upper end connected to the second rearwardly projecting upper stabilizer post 64 and its lower end connected to a second rearwardly projecting lower stabilizer post 71. Each of the stabilizer booster shocks 66 and 70 includes a telescoping cylinder or sleeve-type shock absorber unit 72, and a coil spring 74 which surrounds such unit.

The power train subassembly 14 includes a primary drive shaft 82 which projects forwardly from the prime mover (not shown) on the vehicle 10 toward the cutter drum housing of the road surface treating apparatus of the present invention. The primary drive shaft 82 terminates at its forward end at a universal joint 84. The primary drive shaft is connected through the universal joint 84 to an output secondary drive shaft 85. The secondary drive shaft 85 passes through a bushing sleeve 88 mounted on a rear side of the chain and sprocket housing 55, and enters a gear box 90 mounted within, and supported by, the upper portion of the chain and sprocket housing 55. An output shaft 91 projects laterally from the gear box 90. The direction of extension of the output shaft 91 is toward the left as the cutter drum housing 42 is viewed in FIG. 3. A second end portion 93 of the output shaft projects from the opposite side of the gear box 90 and is used in an up-cutting operational mode hereinafter described. The output shaft 91 carries the drive sprocket 92 at its outermost end (as viewed in FIG. 3). The teeth of the drive sprocket 92 engage a drive chain 94 which extends around, and drivingly engages, a second sprocket 96 which is keyed to the primary central shaft of the cylindrical cutter drum subassembly 52 as shown in FIG. 8.

The hydraulic tool bar control subassembly 22 is illustrated in FIG. 11. The tool bar control subassembly 22 includes a cylinder 100 which contains a piston 102 carried on one end of a piston rod 104 which projects out of the cylinder 100 and carries a clevis 106 which is connected to the tool bar 20. The control subassembly 22 functions to raise the tool bar 20 when the piston rod 104 and piston 102 move upwardly in the cylinder 100, and to force the tool bar downwardly at a time when the piston rod 104 is extended out of the cylinder 100.

The flow of hydraulic fluid to the cylinder 100 is controlled by a four-position control valve 108 by means of which the operator of the apparatus, by manipulating a control handle 110, can cause the tool bar 20, and the tool carried thereon, to be operated in a selected one of four modes. These are an elevated or raised mode, a lowered or depressed mode, a neutral mode and a float mode. When the four-position control valve 108 is placed in the raised mode, hydraulic power fluid passes through a conduit 112 and a flow control valve 114 to the lower end of a hydraulic cylinder 100 so as to cause the piston 102 to be forced upwardly in this cylinder, and thus retract the piston rod 104. The tool bar 20 is thereby raised. The flow control valve 114 has a built-in check valve and operates to cushion or damp the downward force applied to the tool bar 20, so that a sudden force does not cause the tool bar to be driven down with a damaging impact of the tool carried thereon against the surface of the roadway. The flow control valve 114 also acts, at a time when the tool bar 20 is to be retracted, to permit free flow of fluid therethrough, and unrestricted, undamped elevation of the piston.

The second line 116 from the opposite end of the cylinder 100, passes through a flow control valve 118 with a built-in check valve which operates in the opposite way from the flow control valve 114. Thus, this valve 118 damps the flow of fluid back to the source of hydraulic fluid via the four-position control valve 108 so that there is a damping action that prevents a sudden upward movement of the tool bar 20 and the tool carried thereon, whereas there is no restriction applied by this particular valve to the introduction of power fluid to the top of the cylinder 100 for driving the piston 102 downwardly.

The described hydraulic tool bar control subassembly 22 permits the operator to closely control the movements of the tool bar 20 and the tool which it carries. He may, by the use of the handle 110 controlling the valve 108, and by manipulation of the valve 118, control the movements of the tool bar 20 in raising or lowering the tool carried thereon. He may also place the system in "neutral" where the tool is then locked in a particular position in which it has been set relative to the surface of the roadway. Alternatively, he may place the tool in a "float" mode where it can float up and down, freely following anomolies in the roadway, with the tool bar being allowed to move up or down as may be required to accommodate this movement of the tool carried thereon.

The cylindrical cutter drum subassembly 52 which is illustrated in the drawings and here described, is basically a scarifying apparatus which represents but one type of tool for working the surface of a roadway which may optionally be used in the apparatus of the present invention. The particular cutter drum subassembly 52 here employed is used for scarifying a road surface. The scarifying teeth, which are to be hereinafter described, can be replaced, however, by other types of tools with milling teeth carried on milling heads, by a saw blade or multiple saw blades stacked on a rotating shaft, or by various other types of tools which can be selectively mounted on the tool bar 20 for performing different types of cutting, scarifying, gouging, scraping, sweeping, sawing or even painting actions on the surface of a roadway.

Figure 10:
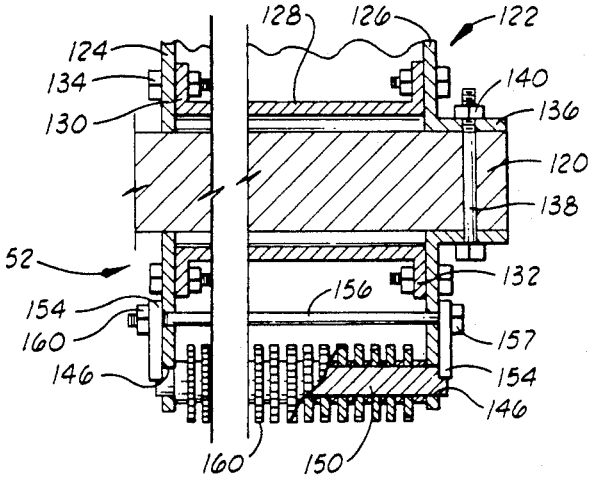
FIG. 10 is a sectional view taken along line 10—10 of FIG. 9.

The cutter drum subassembly 52 includes an elongated drive shaft 120 upon which is mounted for rotation therewith, a multi-part drum structure, which is designated generally by reference numeral 122. The multi-part drum structure 122 includes a pair of generally circular or disk-shaped, horizontally spaced end plates 124 and 126 which are interconnected by means of a flanged internal cylinder 128 which carries bolting flanges 130 and 132 at its opposite ends. The bolting flanges 130 and 132 are bolted by suitable bolts 134 to the circular end plates 124 and 126, and the cylindrical body of the flanged cylindrical member 128 extends concentrically around the shaft 120 as illustrated in FIG. 10. A hub 136 which is formed concentrically to the shaft 120 and joined to the end plate 126 extends around this shaft, as shown in FIG. 10. The hub 136 is keyed to the shaft 120 by means of a bolt 138 which is projected diametrically through the shaft and through the hub, and is locked in this position by a nut 140. It will also be noted that each of the bolting flanges 130 and 132 has a centrally located hole therethrough which has a diameter substantially equivalent to that of the shaft 120.

In each of the circular end plates 124 and 126 there is a plurality of holes formed therethrough, in addition to the holes through which threaded bolts 134 are projected to lock the end plates to the bolting flanges 130 and 132 carried on the internal cylinder 128. Thus, adjacent the outer periphery of each of the circular end plates 124 and 126, a series of circumferentially spaced blade shaft openings are provided, with alternate openings —that is, every other one—of these circumferentially spaced openings being of a diametric size which is relatively larger than the intermediate openings between such alternating, relatively large diameter openings. This facilitates the selective mounting of two different sizes of cutter shafts and cutter blades in the cylindrical cutter drum assembly 52, as will be hereinafter explained.

Figure 9:
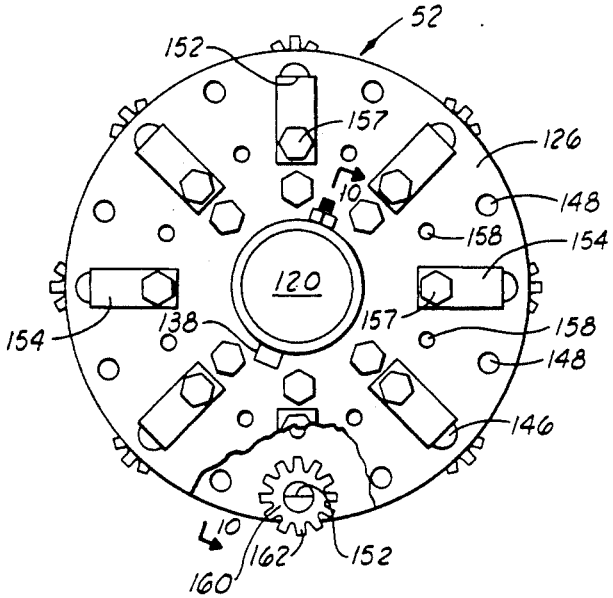
FIG. 9 is an enlarged end view of the cutter drum subassembly utilized in the apparatus of the invention, with a part of one end plate broken away for better understanding of the invention.

In FIG. 9 of the drawings, which is typical of the array of holes through each of the circular end plates 124 and 126, the relatively larger diameter, circumferentially spaced, peripheral holes are denominated by reference numeral 146. The relatively smaller diameter holes are denominated by reference numeral 148.

In the form of the apparatus illustrated in the drawings, the relatively larger diameter holes 146 are shown in use for mounting a plurality of scarifying blades. For this purpose, an elongated shaft 150 is extended between each pair of axially aligned larger diameter holes 146 in the circular end plates 124 and 126, as shown in FIGS. 9 and 10. Each elongated shaft 150 has a notch cut into the shaft along the diameter of the shaft at each end thereof, so that semicircular notches 152 are formed at opposite ends of the shaft. One of the notches 152 is perhaps best illustrated in FIG. 9 where a portion of the end plate 126 has been broken away for clarity of illustration.

The purpose of the flat-sided notches 152 formed on the ends of each of the shafts 150 is to enable a keeper plate 154, having a straight edge across the radially outer end thereof, to be lockingly engaged with the flat surface on the respective notch 152, and in this manner, keep the shaft 150 from rotating. By preventing rotation of each of shafts 150, the larger diameter holes 146 through which the ends of the shafts extend will not be galled or enlarged by the frictional wear which would otherwise be engendered by a rotatable shaft.

Each of the keeper plates 154 having a straight, radially outer end, is pivotally supported on an elongated rod 156 which has a head 157 and which projects through relatively smaller holes 158 formed through the circular end plates 124 and 126 at the locations shown in FIGS. 9 and 10. Each of the elongated keeper plate rods 156 is extended through an aligned pair of relatively smaller holes 158 in the end plates 124 and 126, and through a pair of spaced keeper plates 154 disposed on the outer side of each of these end plates in the manner shown in FIG. 10. It will be perceived in referring to this Figure that each elongated keeper plate rod 156 is secured in position by means of a suitable nut 160 threaded on the end of the keeper plate rod outside one of the end plates 124 or 126.

It should be pointed out that all of the relatively smaller holes 158 are formed on a common circumference or common circle which at all points therearound is equidistantly spaced from the axis of the drive shaft 120. The pivotally supported keeper plates 154 can be swung into position as the several elongated blade shafts 150 are mounted in the cylindrical cutter drum subassembly 152, so as to thus prevent the elongated blade shafts from rotating. It will be noted that the elongated rods 156 shown "in use" in FIGS. 9 and 10 project through alternate ones of the relatively smaller holes 158, and that between each pair of the elongated rods, another one of the rod holes 158 is formed. This arrangement permits the several keeper plates 154 to be shifted when small diameter blade shafts 150 are to be extended through the relatively smaller diameter peripheral holes 148 when small cutter wheels, hereinafter described, are to be used.

As illustrated in FIGS. 9 and 10, the scarification accomplished with the illustrated and described embodiment of the present invention, which embodiment is generally constituted by the cylindrical cutter drum subassembly 52, is accomplished by the use of a plurality of stacked, axially aligned, rotatably mounted scarifier wheels or disks 160. The scarifier wheels 160 carry a plurality of radially outwardly projecting teeth 162 as best illustrated in FIG. 9. The axial array of the scarifier wheels 160, with small spacer blocks between adjacent wheels, is shown in FIG. 10.

The scarifier wheels 160 are rotatably mounted on the elongated blade shafts 150. Thus, as the multi-part drum housing undergoes rotation with the shaft 120 within the cylindrical cutter drum housing 42, the scarifier wheels 160 can rotate on their respective elongated blade shafts 150, and the teeth 162 are consecutively brought into grinding, scarifying contact with the surface of the road.

From the described construction of the cylindrical cutter drum subassembly 52, it will be perceived that the scarifier wheels 160 carried on any one or all of the blade shafts 150 can be quickly and easily changed out for scarifier wheels of relatively smaller diameter carried on smaller diameter shafts extended through the relatively smaller diameter peripheral holes 148. Where such change out is effected, the same keeper plates 154 can be employed to engage the elongated blade shafts 150 by the straight edge carried at the radially outer end of each keeper plate bearing against the flat surface of the keeper plate notch 152 formed at each of the ends of the respective blade shafts.

I the event that it should be desirable to make an up-cut with the scarifier teeth 162 carried on the scarifier wheels 160, or with any other type of cutting element mounted on, or used in, the tool carried at the forward end of the apparatus, the direction of rotation of the shaft 120 is simply reversed. The shaft is then driven in the opposite direction from the clockwise (down-cut) direction it is caused to rotate as it is viewed in FIG. 7. Such reversal in the direction of rotation causes the points of the teeth 162 carried on the scarifier wheels 160 to impact the roadway surface while moving in a forward direction as the drum rotates in a counterclockwise direction as viewed in FIG. 7. This is referred to as up-cutting. Such up-cutting can be easily accomplished with the present invention simply by reversing the gear box 88 so that the shaft 99 which projects from its opposite end is now used to drive a sprocket and the chain 93 and the sprocket carried on the drive shaft 120. The drive shaft 120 will then be driven in the proper direction to develop the up-cutting action by the teeth 162.

OPERATION

In utilizing and operating the road surface treating apparatus of the invention, the apparatus is first connected to the wheel-supported chassis 12 which supports the power plant or prime mover. The prime mover is employed for driving both the self-propelled vehicle 10 upon which the apparatus is mounted, and also the cutter drum subassembly 52 mounted within the cutter drum housing 42 of the apparatus. The cutter drum subassembly 52 is driven in rotation for the purpose of abrading, cutting or scarifying the surface of a road to be treated. Mounting of the road surface treating apparatus is accomplished by pivotally attaching the two opposed, horizontally-spaced, parallel projecting mounting arms 16 and 18 at their rear ends to the chassis by the use of suitable bolts 17 and 19 as depicted in FIGS. 1 and 2.

The power train subassembly 14 is connected to the prime mover by suitably coupling a primary drive shaft 82 to the output from the prime mover and through the universal joint 84 to the secondary drive shaft 85. This secondary drive shaft 85 is coupled through the bushing sleeve 86 to the gear box 90. The output shaft 92 from the gear box 90 functions to drive the drive sprocket 92, and this sprocket engages the drive chain 94 which in turn drives a second sprocket 96 drivingly keyed to the shaft 120 upon which the cylindrical cutter drum subassembly 52 is mounted. As previously pointed out, up-cutting by the teeth 162 (as contrasted with down-cutting) can be accomplished by simply reversing the gear box 88 so that driving is effected from the shaft extension 99.

Finally, the hydraulic lift control subassembly 22 is connected between a source of hydraulic power (not illustrated) on the wheel-supported vehicle 10 and the tool bar 20 so that the tool bar can be raised or lifted upwardly by pivotation of the projecting parallel arms 16 and 18 about a horizontal axis.

At this point, it should be noted that in many instances, the tool bar 20 will be connected to the chassis in the manner described, with the hydraulic lift subassembly 22 in position so that the tool bar can be raised and lowered. The tool bar 20 will be retained on the wheel mounted vehicle by pivotal connection to the chassis as described, and various powered, road-contacting units which conform generally to the principles of the invention herein enunciated, but functioning to achieve different road surface treating results, can be mounted on the tool bar.

Connecting the road surface treating apparatus of this invention to the wheel-supported vehicle 10 for use in treating the surface of a roadway, the forwardly extending frame plates 32 and 34 are connected to the tool bar 20 by bolting them to the tool bar using brackets 36 and 38 in the manner shown in FIG. 1. The forwardly extending frame plates 32 and 34 have secured between their forward ends, a tool mounting plate 40 of the tool-supporting frame subassembly 30. This tool mounting plate 40 provides the points of support needed to stably, yet rockably support, the cutter drum housing 42 and the cylindrical cutter drum subassembly 52 rotatably mounted therein so that it can function as hereinafter described.

For the purpose of providing this support, a rocker shaft or pivot post 44 is mounted to the forward side of the tool-mounting plate 40 and projects forwardly to pivotally support the cutter drum housing 42. The cutter drum housing 42 is thus pivotally mounted so as to facilitate the pivotation of the cutter drum housing about a horizontal, rearwardly extending axis. As will be seen, this is an important feature of the present invention which enables the cutter drum housing 42 and the cutter drum subassembly 52 carried therein to float or rock in a way which accommodates the cutter drum to major anomalies in the surface of the roadway, and prevents breakage due to inability to yield and float over or around aberrations of this type, as may be required from time to time during operation of the apparatus.

In order to damp out, or cushion and smooth to some extent, the oscillatory pivotal motions of the cutter drum housing 42 about a horizontal axis, a pair of stabilizer damping units 66 and 70 are provided. The shock absorber 72 of each unit functions to hydraulically retard motions of the cutter drum housing 42 which tend to raise one end of the housing upwardly as the other end is lowered as a result of pivotation about the pivot post 44. The spring 74 damps or retards movement of the cutter drum housing in the opposite direction, and prevents the pivotal movement of that housing from being erratic. It also prevents over reaction of the cutter drum housing and the cutter subassembly carried therein as anomalies in the road surface are encountered.

Access to the interior of the cutter drum housing 42, and access to the cylindrical cutter drum subassembly 52 mounted rotatably within the housing can be attained by opening the access door 53 located at the drum housing 42. By this means, as well as by lifting the inclined forward plate 51, access can be had to parts of the cylindrical cutter drum subassembly 52 for limited maintenance or repair as may be needed or desirable.

The apparatus of the invention functions very effectively for relatively high speed treatment of a roadway surface as the wheel-supported vehicle is driven thereover, and as the circular cutter wheels 160 are brought to bear against the road surface. The ability of the cutter drum housing 42 and the cutter drum subassembly 52 carried therein to float—meaning to rock from side-to-side about a horizontal, longitudinal axis—as the apparatus is moved along a roadway, greatly increases the long term cutting efficiency by preservation of the sharpness of various working elements constituting a part of the assembly.

Although a preferred embodiment of the invention has been herein described in order to enable those skilled in the art to understand the invention, and to be able to reproduce it from the description here appearing, it will be understood that this preferred embodiment which has been here described in detail is but one of many embodiments which can be constructed, all in reliance upon the same basic and underlying principles. Therefore, changes and modifications of structure which continue to rely on such basic underlying principles are deemed to be circumscribed by the spirit and scope of the invention, except as the same may be limited by the appended claims or reasonable equivalents thereof.

What is claimed is:

1. A road surface treating apparatus comprising:

a framework;

a pair of arms each having a forward end and a rear end and each pivotally connected at its rear end to said framework for pivotation about a horizontal, substantially transversely extending axis and projecting forwardly from said point of pivotal connection to the forward end of the respective arm;

a transverse tool bar extending substantially horizontally and transversely with respect to the direction of movement of siad framework, said transverse tool bar being mounted on the forward ends of said arms and extending transversely there across;

a tool-supporting frame subassembly detachably and adjustably mounted on said tool bar;

a rocker shaft extending forward from, and normal to, said transversely extending frame plate;

a drum housing freely pivotally mounted on the forward end of said rocker shaft and on the opposite side of said frame subassembly from said tool bar for free pivotation about a fore-and-aft horizontal axis to thereby facilitate free floating, rocking movement of said drum housing in response to road anomalies traversed by said apparatus;

a generally cylindrical cutter drum subassembly rotatably mounted in said drum housing for rotation about a substantially horizontal, transversely extending axis, said cutter drum subassembly further including:

a plurality of circumferentially spaced rows of cutter elements mounted on the outer periphery of said cylindrical cutter drum subassembly, said rows of cutter elements extending substantially parallel to each other and over a major portion of the width of said generally cylindrical cutter drum subassembly;

a pair of horizontally spaced shock absorber units each having a first end connected to a point on said drum housing, with said points of connection of said first ends of said shock absorber units to said drum housing being on opposite sides of said horizontal pivotal axis of said drum housing on said tool-supporting frame, each of said shock absorber units further having a second end connected to a point on said tool-supporting frame, so that each of said shock absorber units extends one of said first-mentioned points on said drum housing and one of said last-mentioned point on said tool-supporting frame;

a prime mover mounted on said framework; and a power train connected between said prime mover and said generally cylindrical cutter drum subassembly for driving said cutter drum subassembly in rotation.

2. A road surface treating apparatus as defined in claim 1 and further characterized as including a piston and cylinder assembly connected between said framework and said tool bar for raising and lowering said tool bar and the tool-supporting frame mounted on the tool bar.

3. A road surface treating apparatus as defined in claim 1 wherein said tool-supporting frame comprises:

a pair of parallel, forwardly extending frame plates each having one end connected to said tool bar and each having a forward second end; and a transversely extending frame plate extending between, and jointed to, the forward second ends of said parallel frame plates.

4. A road surface treating apparatus comprising:

a framework;

a pair of arms each having a forward end and a rear end and each pivotally connected at its rear end to said framework for pivotation about a horizontal, substantially transversely extending axis, and each projecting forwardly from said rear end point of pivotal connection to the forward end of the respective arm;

a transverse tool bar extending substantially horizontally and transversely with respect to the direction of movement of said framework, said transverse tool bar being mounted on the forward ends of said arms and extending transversely there across;

a tool-supporting frame subassembly detachably and adjustably mounted on said tool bar, said tool-supporting frame subassembly comprising:

a pair of parallel, forwardly extending frame plates each having one end connected to said tool bar, and each having a forward second end; and a transversely extending frame plate extending between, and jointed to, the forward second ends of said parallel frame plates;

a rocker shaft extending forward from, and normal to, said transversely extending frame plate;

a drum housing freely pivotally mounted on the forward end of said rocker shaft and on the opposite side of said frame subassembly from said tool bar for free pivotation about a fore-and-aft horizontal pivotal axis to thereby facilitate free floating, rocking movement of said drum housing in response to road anomalies traversed by said apparatus;

a generally cylindrical cutter drum subassembly rotatably mounted in said drum housing for rotation about a substantially horizontal, transversely extending axis, said cutter drum subassembly further including a plurality of circumferentially spaced rows of cutter elements mounted at the outer periphery of said cylindrical cutter drum subassembly, said rows of cutter elements extending substantially parallel to each other and over a major portion of the width of said generally cylindrical cutter drum subassembly;

a pair of horizontally spaced shock absorber units each having a first end connected to a point on said drum housing, with said points of connection of said first ends of said shock absorber units to said drum housing being on opposite sides of said horizontal pivotal axis of said drum housing on said tool-supporting frame, each of said shock absorber units further having a second end connected to a point on said tool-supporting frame, so that each of said chock absorber units extends between one of said first-mentioned points on said drum housing and one of said last-mentioned points on said tool-supporting frame;

a prime mover mounted on said framework; and a power train connected between said prime mover and said generally cylindrical cutter drum subassembly for driving said cutter drum subassembly in rotation.

5. A road surface treating apparatus comprising:

a framework;

a pair of arms each having a forward end and a rear end and each pivotally connected at its rear end to said framework for pivotation about a horizontal, substantially transversely extending axis and projecting forwardly from said rear end point of pivotal connection to the forward end of the respective arm;

a transverse tool bar extending horizontally and substantially transversely with respect to the direction of extension of said pair of arms, said transverse tool bar being mounted on the forward ends of said arms;

a tool-supporting frame subassembly detachably and adjustably mounted on said tool bar, said tool supporting frame comprising:

a pair of parallel, spaced, forwardly extending frame plates each having one end connected to said tool bar and each having a forward second end; and a transversely extending frame plate extending between, and jointed to, the forward second ends of said parallel frame plates;

a rocker shaft extending forward from, and substantially normal to said transversely extending frame plate;

a drum housing freely pivotally mounted on the forward end of said rocker shaft and on the opposite side of said frame subassembly from said tool bar for pivotation about a fore-and-aft horizontal axis to thereby facilitate free floating, rocking movement of said drum housing in response to road anomalies traversed by said apparatus;

a generally cylindrical cutter drum subassembly rotatably mounted in said drum housing for rotation about a substantially horizontally, transversely extending axis, said cuter drum subassembly further including a plurality of cutter elements mounted at the outer periphery of said cylindrical cutter drum subassembly; and a pair of horizontally spaced shock absorber units each having a first end connected to a point on said drum housing with said points of connection of said two shock absorber units to said drum housing being on opposite sides of said horizontal pivotal axis of said drum housing on said rocker shaft, each of said shock absorber units further having a second end connected to a point on said transversely extending frame plate so that each of said shock absorbers extends between one of said first-mentioned points on said drum housing and one of said second-mentioned points on said transversely extending frame plate; and a prime mover mounted on said framework; and a power train connected between said prime mover and said generally cylindrical cutter drum for driving said cutter drum subassembly in rotation.

* * * * *

UNITED STATES PATENT AND TRADEMARK OFFICE

CERTIFICATE OF CORRECTION

PATENT NO. : 5,046,890

DATED : September 10, 1991

INVENTOR(S) : Wayne E. Dickson

It is certified that error appears in the above-identified patent and that said Letters Patent is hereby corrected as shown below:

In Column 1, line 17, after "surface of" insert -a-.
In Column 1, line 58, delete "too" and insert -tool-.
In Column 9, line 25, delete "I" and insert -In-.

In Column 11, line 55, after "and" insert -substantially-.
In Column 12, line 16, after "extends" insert -between-.
In Column 12, line 18, delete "point" and insert -points-.
In Column 12, line 37, delete "jointed" and insert -joined-.
In Column 12, line 60, delete "jointed" and insert -joined-.
In Column 13, line 23, delete "chock" and insert -shock-.
In Column 14, line 9, delete "jointed" and insert -joined-.
Column 14, line 24, delete "cuter" and insert --cutter--.

Signed and Sealed this

Nineteenth Day of January, 1993

*Attest:*

DOUGLAS B. COMER

*Attesting Officer*

*Acting Commissioner of Patents and Trademarks*